US008005658B2

(12) United States Patent
Tilke et al.

(10) Patent No.: US 8,005,658 B2
(45) Date of Patent: Aug. 23, 2011

(54) AUTOMATED FIELD DEVELOPMENT PLANNING OF WELL AND DRAINAGE LOCATIONS

(75) Inventors: Peter Gerhard Tilke, Belmont, MA (US); William J. Bailey, Somerville, MA (US); Benoit Couet, Belmont, MA (US); Michael Prange, Somerville, MA (US); Martin Crick, Abingdon (GB)

(73) Assignee: Schlumberger Technology Corporation, Cambridge, MA (US)

( * ) Notice: Subject to any disclaimer, the term of this patent is extended or adjusted under 35 U.S.C. 154(b) by 901 days.

(21) Appl. No.: 11/756,244

(22) Filed: May 31, 2007

(65) Prior Publication Data

US 2008/0300793 A1 Dec. 4, 2008

(51) Int. Cl.

| | |
|---|---|
| ***G06F 17/50*** | (2006.01) |
| ***G06G 7/48*** | (2006.01) |
| ***G01V 3/38*** | (2006.01) |
| ***G01V 1/40*** | (2006.01) |

(52) U.S. Cl. ..... 703/10; 703/1; 702/5; 702/9; 702/13

(58) Field of Classification Search ..... 703/1, 10; 702/5, 9, 13

See application file for complete search history.

(56) References Cited

U.S. PATENT DOCUMENTS

| | | | | |
|---|---|---|---|---|
| 4,249,776 | A | 2/1981 | Shuck et al. | |
| 6,549,879 | B1 | 4/2003 | Cullick et al. | |
| 7,054,753 | B1 * | 5/2006 | Williams et al. | 702/13 |
| 7,062,420 | B2 * | 6/2006 | Poe, Jr. | 703/10 |
| 7,460,957 | B2 * | 12/2008 | Prange et al. | 702/9 |
| 2004/0153299 | A1 | 8/2004 | Colvin et al. | |
| 2006/0151214 | A1 | 7/2006 | Prange et al. | |
| 2007/0156377 | A1 * | 7/2007 | Gurpinar et al. | 703/10 |
| 2008/0288226 | A1 * | 11/2008 | Gurpinar et al. | 703/10 |

OTHER PUBLICATIONS

"Low-Impairment Mud System for Drilling Horizontal Wells Through Clastic Reservoirs in a South Oman Oil Field", Glendinning, et al. Middle East Oil Show, Apr. 3-6, 1993, Bahrain.*

Rosenwald et al., A Method for Determining the Optimum Location of Wells in a Reservoir Using Mixed-Integer Programming, Society of Petroleum Engineers Journal, vol. 14, No. 1, pp. 44-54, 1974.

Beckner et al., Field Development Planning Using Simulated Annealing-Optimal Economic Well Scheduling and Placement, SPE 30650, pp. 209-221, 1995.

(Continued)

*Primary Examiner* — Jason Proctor
*Assistant Examiner* — Nithya Janakiraman
(74) *Attorney, Agent, or Firm* — Helene Raybaud; Rachel Greene; Brigid Laffey

(57) ABSTRACT

A hybrid evolutionary algorithm ("HEA") technique is described for automatically calculating well and drainage locations in a field. The technique includes planning a set of wells on a static reservoir model using an automated well planner tool that designs realistic wells that satisfy drilling and construction constraints. A subset of these locations is then selected based on dynamic flow simulation using a cost function that maximizes recovery or economic benefit. In particular, a large population of candidate targets, drain holes and trajectories is initially created using fast calculation analysis tools of cost and value, and as the workflow proceeds, the population size is reduced in each successive operation, thereby facilitating use of increasingly sophisticated calculation analysis tools for economic valuation of the reservoir while reducing overall time required to obtain the result. In the final operation, only a small number of full reservoir simulations are required for the most promising FDPs.

30 Claims, 11 Drawing Sheets

OTHER PUBLICATIONS

Santellani et al., "Survival of the Fittest" an Optimised Well Location Algorithm for Reservoir Simulation, SPE 39754, pp. 255-261, 1998.
Ierapetritou et al., Optimal Location of Vertical Wells: Decomposition Approach, AIChE Journal, vol. 45, No. 4, pp. 844-859, Apr. 1999.
Güyagüler et al., Optimization of well Placement in a Gulf of Mexico Waterflooding Project, SPE 63221, pp. 1-10, 2000.
Yeten et al., Optimization of Nonconventional Well Type, Location and Trajectory, SPE 77565, pp. 1-14, 2002.
Badru et al., Well Placement Optimization in Field Development, SPE 84191, pp. 1-9, 2003.
Güyagüler et al., Uncertainty Assessment of Well-Placement Optimization, SPE 87663, 24-32, 2004.
Cullick et al., Optimizing Multiple-Field Scheduling and Production Strategy with Reduced Risk, SPE 84239, pp. 1-12, 2003.
Cullick et al., Optimal Field Development Planning of Well Locations With Reservoir Uncertainty, SPE 96986, pp. 1-12, 2005.
Gutteridge et al., Connected Volume Calibration for Well-Path Ranking, SPE 35503, pp. 197-206, 1996.
Seifert et al., Well Placement Optimisation and Risking using 3-D Stochastic Reservoir Modelling Techniques, SPE 35520, pp. 289-300, 1996.
Cottini-Loureiro A., et al, "Optimized Well Location by Combination of Multiple Realization Approach and Quality Map Methods" Society of Petroleum Engineers, SPE 95413, pp. 1-10, 2005.

* cited by examiner

| FIG.3A |
| --- |
| FIG.3B |

AUTOMATED FIELD DEVELOPMENT PLANNING OF WELL AND DRAINAGE LOCATIONS

FIELD OF THE INVENTION

This invention is generally related to oil and gas wells, and more particularly to automatically computing preferred locations of wells and production platforms in an oil or gas field.

BACKGROUND OF THE INVENTION

Determining the placement of wells is an important step in exploration and production management. Well placement affects the performance and viability of a field over its entire production life. However, determining optimum well placement, or even good well placement, is a complex problem. For example, the geology and geomechanics of subsurface conditions influence both drilling cost and where wells can be reliably placed. Well trajectories must also avoid those of existing wells. Further, wells have practical drilling and construction constraints. Constraints also exist at the surface, including but not limited to bathymetric and topographic constraints, legal constraints, and constraints related to existing facilities such as platforms and pipelines. Finally, financial uncertainty can affect the viability of different solutions over time.

There is a relatively long history of research activity associated with development of automated and semi-automated computation of field development plans (FDPs). Most or all studies recognize that this particular optimization problem is highly combinatorial and non-linear. Early work such as Rosenwald, G. W., Green, D. W., 1974, *A Method for Determining the Optimum Location of Wells in a Reservoir Using Mixed-Integer Programming*, Society of Petroleum Engineering Journal 14 (1), 44-54; and Beckner, B. L., Song, X., 1995, *Field Development Planning Using Simulated Annealing*, SPE 30650; and Santellani, G., Hansen, B., Herring, T., 1998, *"Survival of the Fittest" an Optimized Well Location Algorithm for Reservoir Simulation*, SPE 39754; and Ierapetritou, M. G., Floudas, C. A., Vasantharajan, S., Cullick, A. S., 1999, *A Decomposition Based Approach for Optimal Location of Vertical Wells* in American Institute of Chemical Engineering Journal 45 (4), pp. 844-859 is based on mixed-integer programming approaches. While this work is pioneering in the area, it principally focuses on vertical wells and relatively simplistic static models. More recently, work has been published on a Hybrid Genetic Algorithm ("HGA") technique for calculation of FDPs that include non-conventional, i.e., non-vertical, wells and sidetracks. Examples of such work include Guiyaguler, B., Home, R. N., Rogers, L., 2000, *Optimization of Well Placement in a Gulf of Mexico Waterflooding Project*, SPE 63221; and Yeten, B., Durlofsky, L. J., Aziz, K., 2002, *Optimization of Nonconventional Well Type, Location and Trajectory*, SPE 77565; and Badra, O., Kabir, C. C., 2003, *Well Placement Optimization in Field Development*, SPE 84191; and Guiyaguler, B., Home, R. N., 2004, *Uncertainty Assessment of Well Placement Optimization*, SPE 87663. While the HGA technique is relatively efficient, the underlying well model is still relatively simplistic, e.g., one vertical segment down to a kick-off depth (heal), then an optional deviated segment extending to the toe. The sophistication of optimized FDPs based on the HGA described above has grown in the past few years as the time component is being included to support injectors, and uncertainty in the reservoir model is being considered. Examples include Cullick, A. S., Heath, D., Narayanan, K., April, J., Kelly, J., 2003, *Optimizing multiple-field scheduling and production strategy with reduced risk*, SPE 84239; and Cullick, A. S., Narayanan, K., Gorell, S., 2005, *Optimal Field Development Planning of Well Locations With Reservoir Uncertainty*, SPE 96986. However, improved automated calculation of FDPs remains desirable.

SUMMARY OF THE INVENTION

An automated process for determining the surface and subsurface locations of producing and injecting wells in a field is disclosed. The process involves planning multiple independent sets of wells on a static reservoir model using an automated well planner. The most promising sets of wells are then enhanced with dynamic flow simulation using a cost function, e.g., maximizing either recovery or economic benefit. The process is characterized by a hierarchical workflow which begins with a large population of candidate targets and drain holes operated upon by simple (fast) algorithms, working toward a smaller population operated upon by complex (slower) algorithms. In particular, as the candidate population is reduced in number, more complex and computationally intensive algorithms are utilized. Increasing algorithm complexity as candidate population is reduced tends to produce a solution in less time, without significantly compromising the accuracy of the more complex algorithms.

In accordance with one embodiment of the invention, a method of calculating a development plan for at least a portion of a field containing a subterranean resource, comprises the steps of: identifying a population of target sets in the field; reducing this population by selecting a first sub population with a first analysis tool; reducing the first sub population by selecting a second sub population of target sets with a second analysis tool, the second tool utilizing greater analysis complexity than the first analysis tool; calculating FDPs from the second sub population of target sets; and presenting the FDPs in tangible form.

In accordance with another embodiment of the invention, a computer-readable medium encoded with a computer program for calculating a development plan for at least a portion of a field containing a subterranean resource, comprises: a routine which identifies a population of target sets in the field; a routine which reduces the population of target sets by selecting a first sub population of the target sets with a first analysis tool; a routine which reduces the first sub population by selecting a second sub population of target sets with a second analysis tool, the second tool utilizing greater analysis complexity than the first analysis tool; a routine which calculates a FDP from the second sub population of target sets; and a routine which presents the FDPs in tangible form.

Further features and advantages of the invention will become more readily apparent from the following detailed description when taken in conjunction with the accompanying drawings.

DETAILED DESCRIPTION

Figure 1:
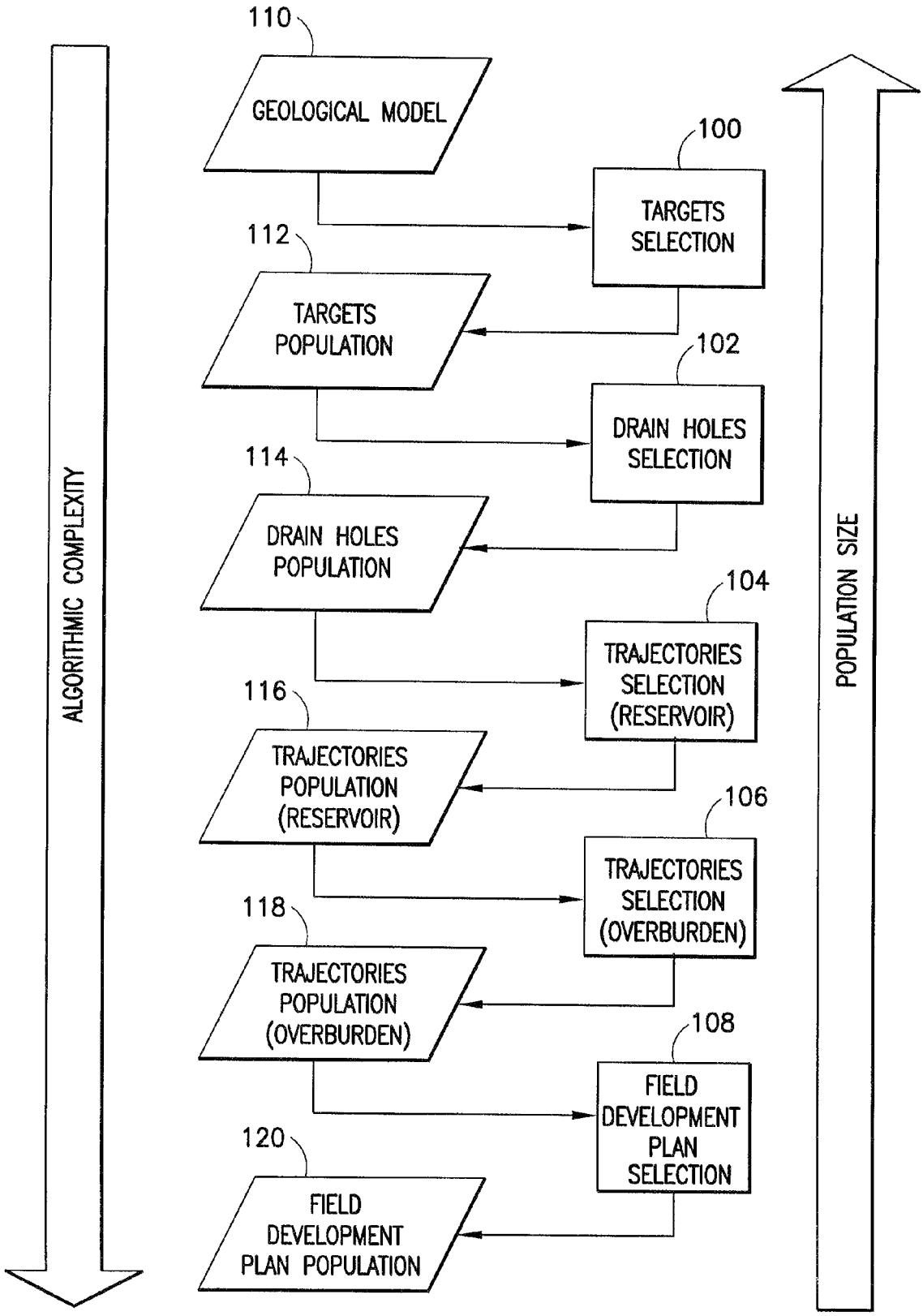
FIG. 1 is a flow diagram which illustrates automated computation of locations of wells and production platforms in an oil or gas field.

FIG. 1 illustrates a technique for automated computation of a FDP including locations of wells and production platforms in an oil or gas field. Workflow is organized into five main operations: target selection (100), drain hole selection (102), reservoir trajectory selection (104), overburden trajectory selection (106), and FDP selection (108).

The target selection operation (100) is initialized by generating a large initial population (112) of target sets from a geological model (110). For example, 1000 different target sets might be generated, although the actual population size is dependent on the complexity of the field and other considerations. Each member of the population is a complete set of targets to drain the reservoir(s), and each target is characterized by an estimate of its value. For example, a simple value estimate is the associated stock tank oil initially in place ("STOIIP"). In subsequent operations, the large initial population of target sets is gradually reduced in size as each step progressively identifies the more economically viable subsets of the population.

The drain hole selection operation (102) includes generating a population (114) of drain-hole sets from the target population (112). Each drain hole is an ordered set of targets that constitutes the reservoir-level control points in a well trajectory. Each member of the generated population (114) is a complete set of drain holes to drain the reservoir(s). Each drain hole set comprises targets from a single target set created in the previous operation. It should be noted that multiple drain hole sets may be created for a single target set. Each drain hole set has an associated value which could be, for example and without limitation, STOIIP, initial flow rate, decline curve profile, or material balance profile.

The reservoir trajectory selection operation (104) includes generating a population (116) of trajectory sets from the drain hole population (114). In particular, each member of the generated population (116) represents a completion derived from the corresponding drain-hole set created in the previous operation (102). Each well trajectory is a continuous curve connecting the targets in a drain hole. At the end of this operation (104), the approximate economic value of each trajectory set is evaluated based on the STOIIP values of its targets and the geometry of each well trajectory. These values are used to reduce the size of the population by selecting the population subset with the largest economic values, i.e., the "fittest" individuals. For example, by selecting the "fittest" 10% of individual subsets, the size of the population can be reduced by one order of magnitude, e.g., from 1000 to 100.

In the overburden trajectory selection operation (106) each trajectory in the remaining population (116) of trajectory sets created in the previous operation (104) is possibly modified to account for overburden effects such as drilling hazards. At the end of this operation (106) the approximate economic value of each trajectory set is evaluated using STOIIP and geometry, as in the previous operation, but also with respect to drilling hazards. The "fittest" individuals with respect to economic value are then selected and organized into a population (118) for use in the next operation (108). For example, by selecting the "fittest" 10% of these individuals it is possible to further reduce the size of the population by another order of magnitude, e.g., from 100 to 10.

The FDP selection operation (108) includes performing rigorous reservoir simulations on the remaining relatively small population (118) of trajectory sets, e.g., 10. The economic value of each member of the population is evaluated using trajectory geometry, drilling hazards and the production predictions of the reservoir simulator. These values can be used to rank the FDPs in the remaining small population. The FDP with the greatest rank may be presented as the selected plan, or a set of greatest ranked plans may be presented to permit planners to take into account factors not included in the automated computations, e.g., political constraints. The result is a FDP population (120).

Figure 2:
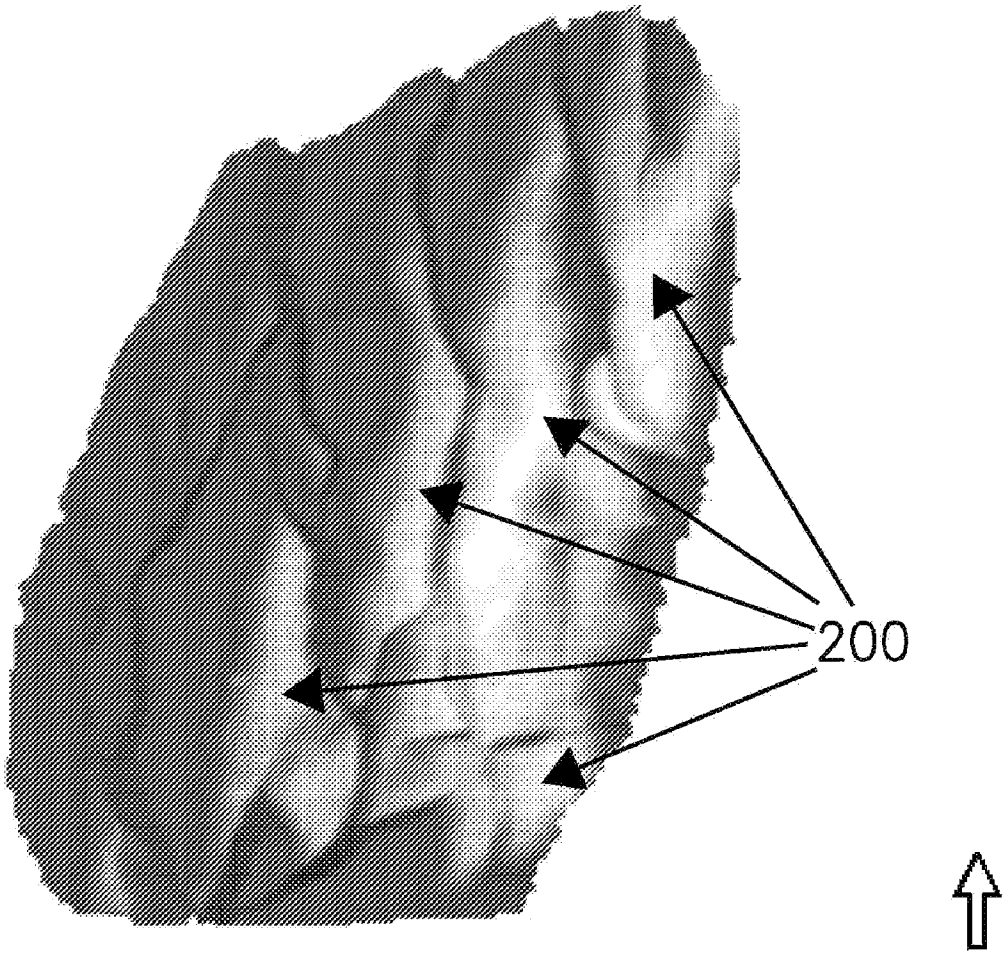
FIG. 2 illustrates an exemplary field used to describe operation of an embodiment of the invention.

A particular embodiment of the workflow of FIG. 1 will now be described with regard to the exemplary field illustrated in FIG. 2. The illustrated field includes discrete hydrocarbon reservoirs (200) with boundaries defined by subterranean features such as faults. STOIIP is indicated by color intensity, where green is indicative of greater STOIIP, and blue is indicative of lesser STOIIP.

Figures 3, 3A:
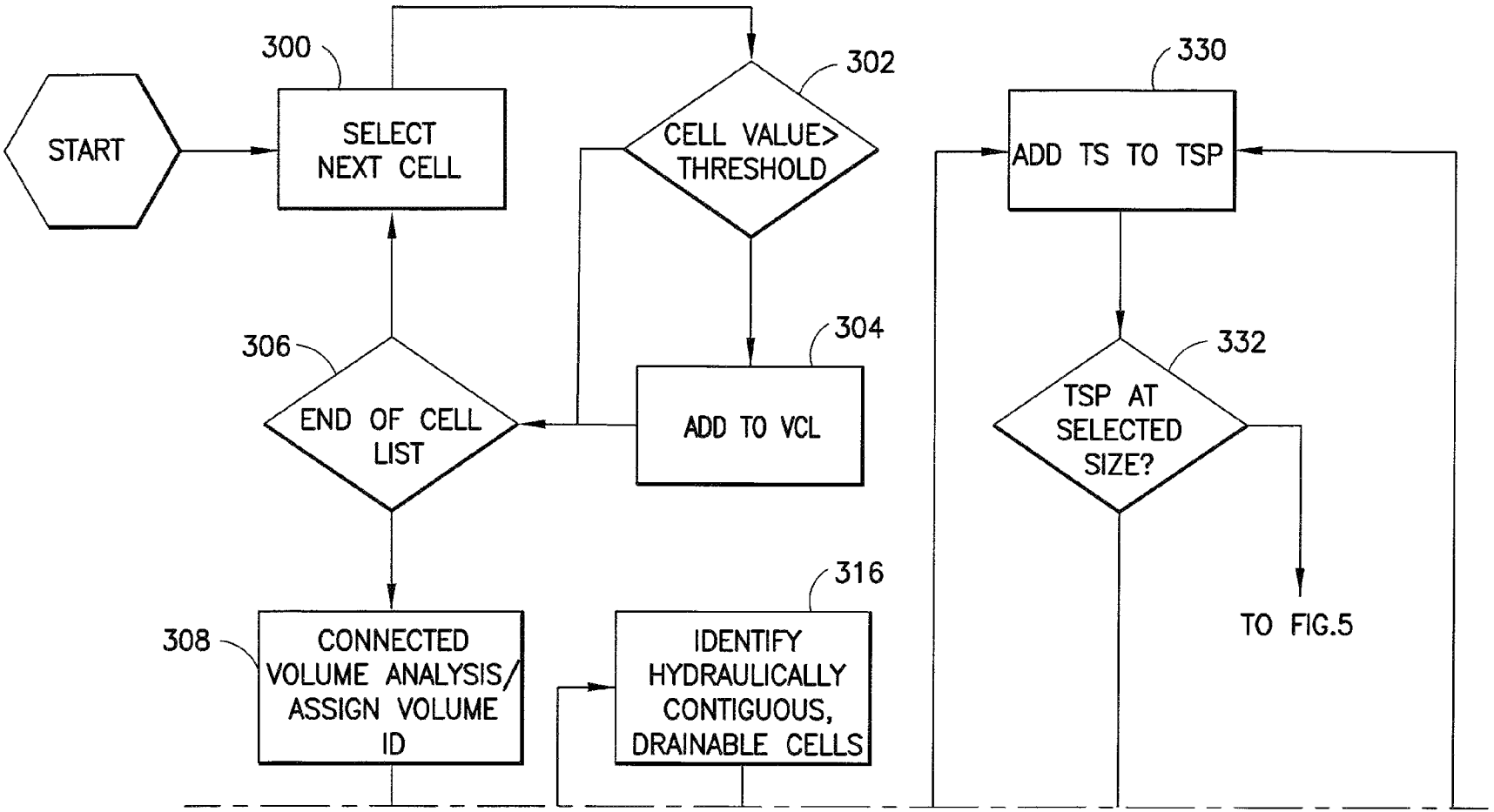
FIG. 3 illustrates a target selection algorithm.
Figure 3B:
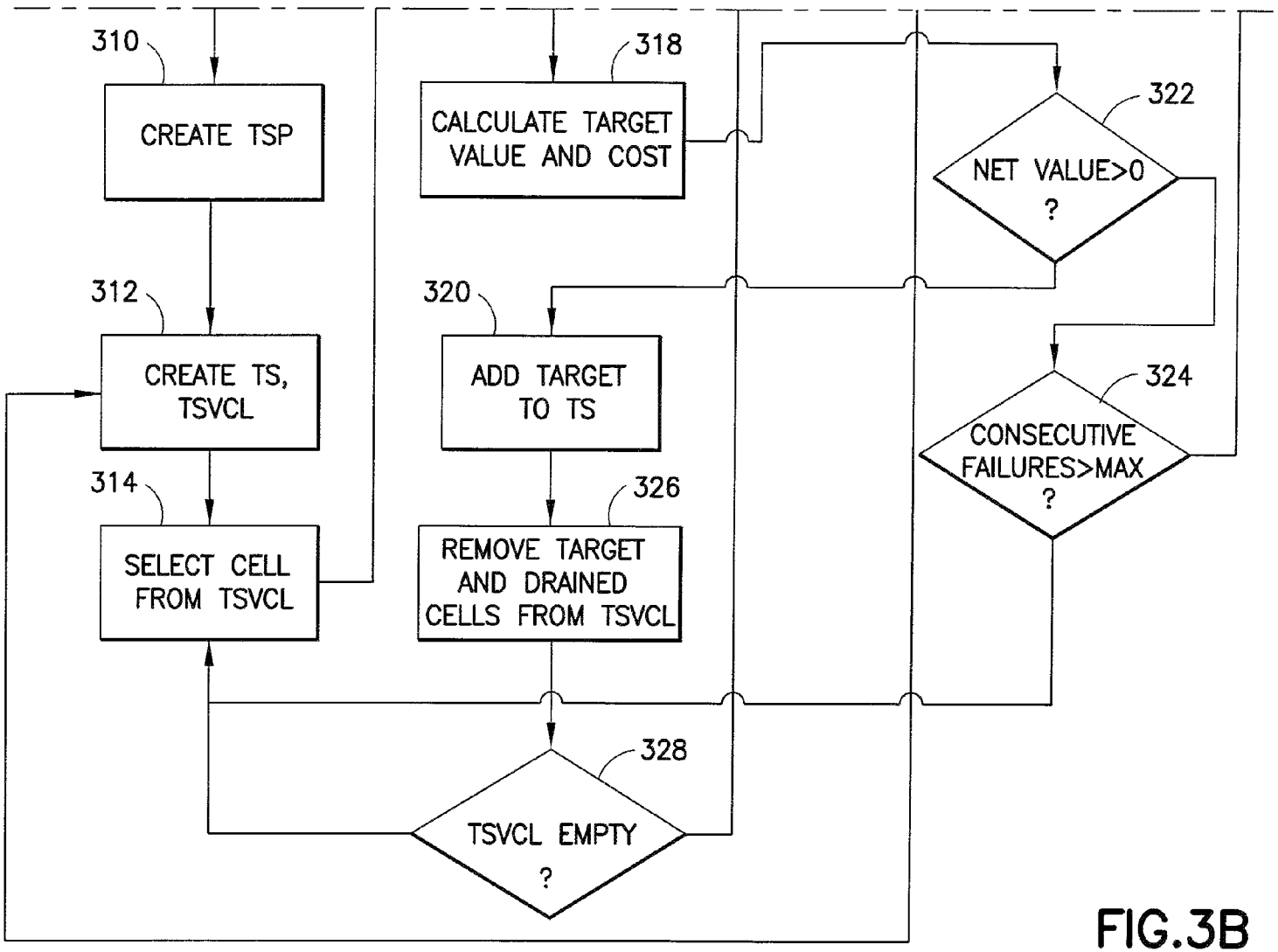
Figure 4:
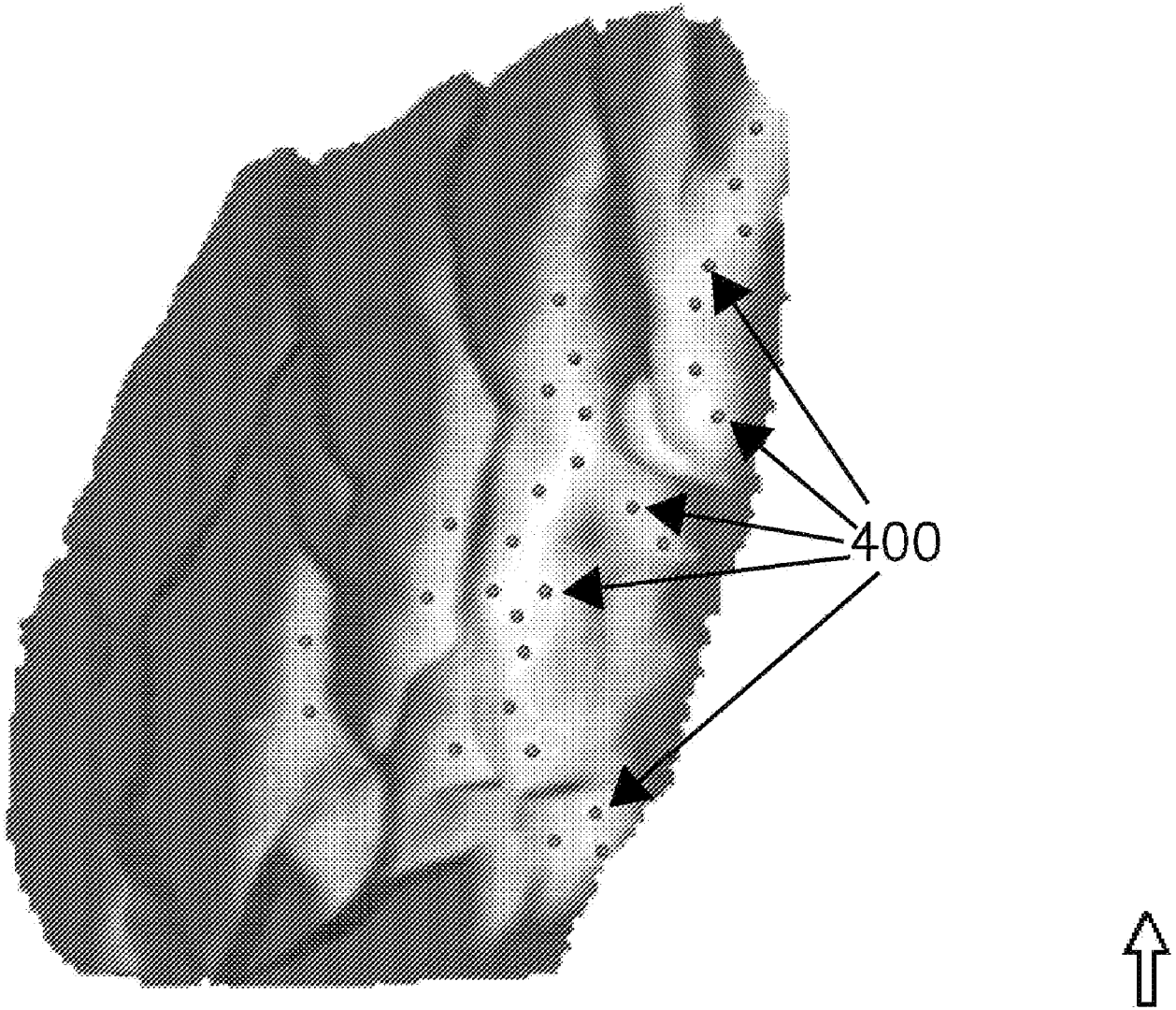
FIG. 4 illustrates placement of targets in the field of FIG. 2.

FIGS. 3 and 4 illustrate an embodiment of target set generation and selection in greater detail. The number of illustrated targets (40) is relatively small for clarity of illustration and ease of explanation. As stated above, each member of the population is a complete set of targets to drain the reservoir (s). A series of steps are executed to identify all valid cells in the reservoir model that could be potential well targets, and create a list of valid cells, i.e., Valid Cell List ("VCL"). A potential cell is selected as indicated by step (300). The value of the selected cell is then compared with a threshold as indicated by step (302). Valid cells are characterized by one or more of a minimum value of STOIIP, minimum recovery potential, and analogous selection criteria. If the selected cell is valid, it is added to the VCL as indicated by step (304). This process continues until reaching the end of the cell list, as indicated by step (306). A connected volume analysis is then performed, as indicated by step (308), assigning each cell a volume id. Cells with the same volume id are considered hydraulically contiguous. Tools for performing this analysis exist in modern interpretation software, e.g., Petrel 2007. The next steps (310, 312) are associated with initialization: create an empty Target Set Population ("TSP"), an empty Target Set ("TS"), and a Target Set Valid Cell List ("TSVCL") by copying the VCL. The next step is to randomly select a target, as indicated by step (314), i.e., randomly selecting a cell from the TSVCL. The next step (316) is to analytically identify all the hydraulically contiguous cells that could be drained by a completion at the center of the cell. Target cost and value are calculated as indicated by step (318). The value of the target is the total STOIIP of the drained cells. The cost of the target is the cost of a vertical well to the center of the target cell, and the net value is then given by the value minus the cost. If the net value is positive, as determined in step (322), then the target is added to the TS as indicated in step (324). If net value is negative, as determined in step (322), then target should not be added to the TS. In that case, step (324) tests if consecutive failures (negative nets) is greater than a maximum. If true, then control passes to step (330), else control passes back to step (314), and a new target is selected from the TSVCL. If the target cell is added to the TS, as shown in step (324), the target cell and additional drained cells are then removed from the TSVCL, as indicated by step (326). Target selection (step 314) is repeated for remaining cells in the TSVCL until no cells remain in TSVCL, as determined at step (328). The populated TS is added to TSP as indicated in step (330). Flow returns to step (312), unless the TSP has reached desired size or unique target sets cannot be found, as indicated in step (332).

Figure 5:
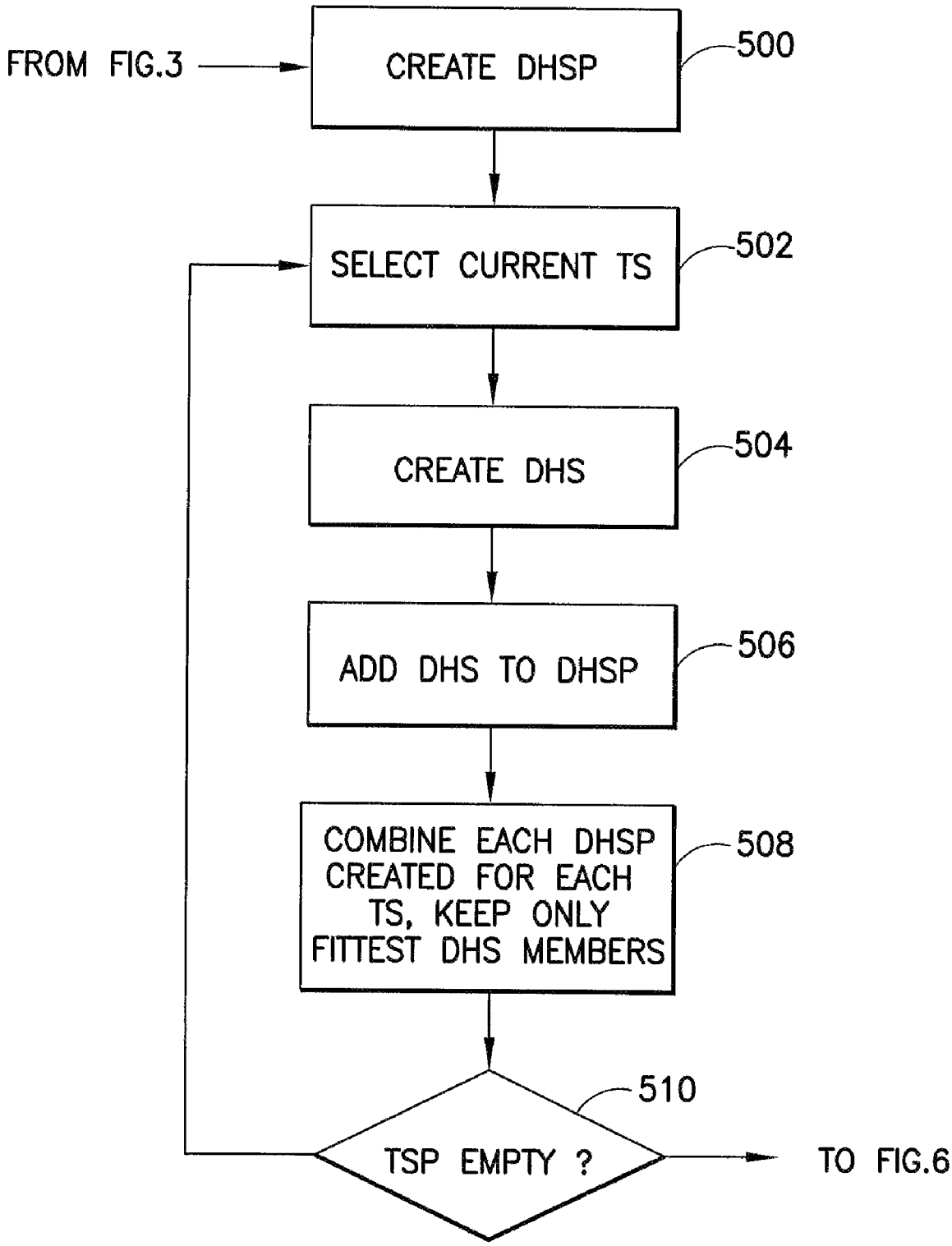
FIG. 5 illustrates a drain hole selection algorithm.
Figures 6, 7:
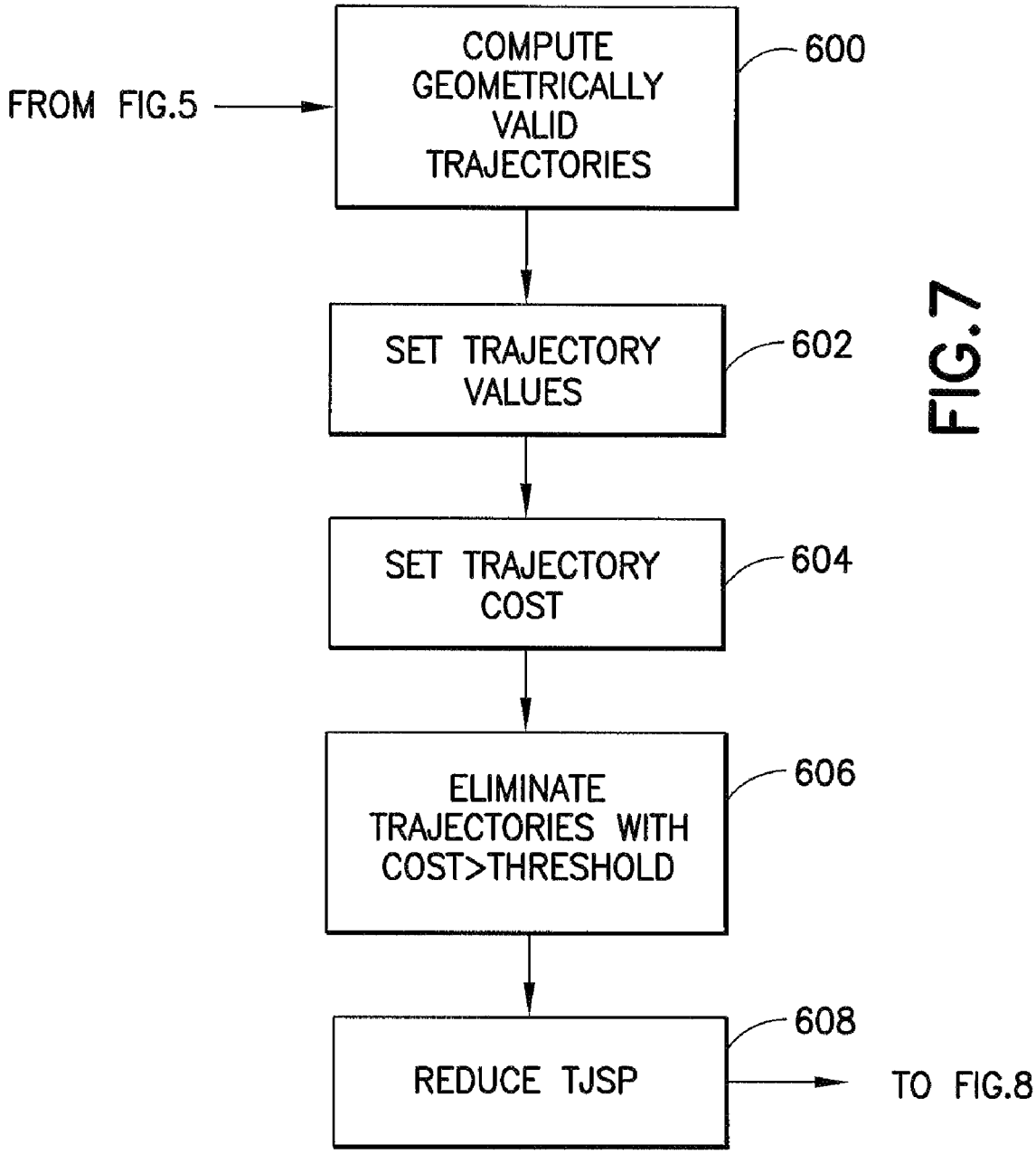
FIG. 6 illustrates a reservoir trajectory selection algorithm.
FIG. 7 illustrates selected drain holes and reservoir trajectories in the field of FIG. 2.
Figure 7:
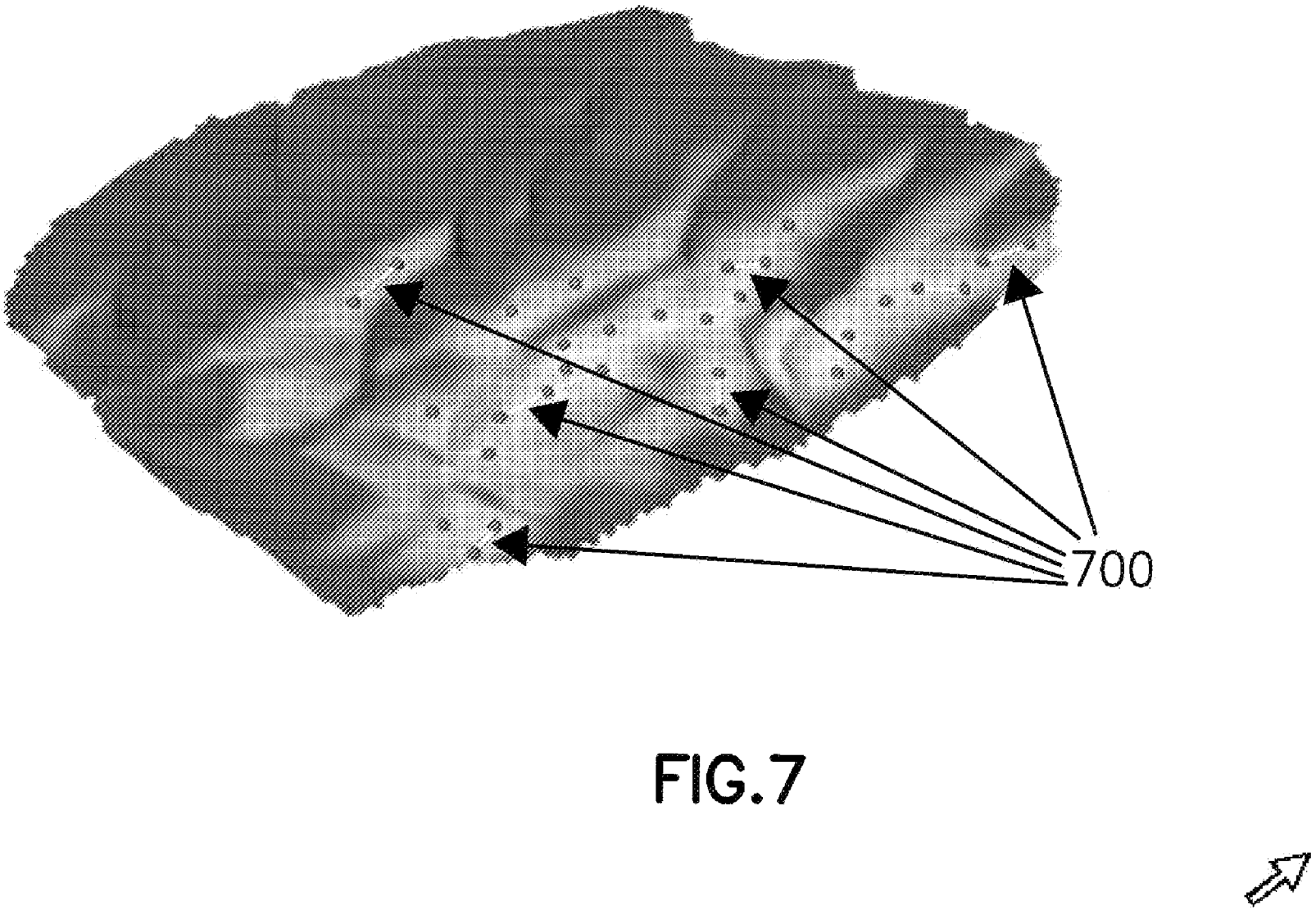

An embodiment of drain hole selection is illustrated in greater detail in FIGS. 5 and 7. The population of drain hole sets is generated as already described, where each member of the population is a complete set of drain holes to drain the reservoir(s) (one set of drain holes (700) is shown). The procedure initially creates a Drain Hole Set Population ("DHSP") container which will contain a population Drain Hole Sets ("DHS") as shown in step (500). The procedure then loops over each TS in the TSP, selecting the current TS, as shown in step (502). A Drain Hole Set ("DHS") is generated by converting the TS into a DHS as indicated by step (504). In this case, each target in the TS becomes a single target Drain Hole (DH). The value of the DH is the value of the target. The cost of the DH is the cost of a vertical well to the target. This initial DHS is added to the DHSP as indicated by step (506). For the current TS, new DHSs are created by stochastically combining DHs from the existing initial DHS as indicated by step (508). For the combination of each DH into a new merged DH to be valid, each node in the resulting DH must be deeper than the preceding node. The value of the resulting DH may be computed in a number of ways. One way to compute the value of the DH is the STOIIP available for drainage by the DH. To be available, it must be in the same connected volume as the DH and must be closer to the current DH than another valid DH. The initial flow rate is computed as an analytical approximation to a reservoir simulator formulation. A decline curve profile is computed by combining the STOIIP with an initial flow rate, and then using a simple decline curve to produce a profile for the well, and then calculating a net present value (NPV), or net production. Finally, using the STOIIP and initial rate as discussed above, a material balance calculation is performed to produce a production profile for the well to calculate NPV. This is effectively doing a one cell simulation. The cost of the DH is the sum of analytically computed cost of each segment of the DH and the vertical segment to the surface. For a given TS, step (508) is repeated either until the maximum number of DHSs per TS is exceeded, or no new unique DHSs are found, or no new DHSs with positive net value are found. Steps (502) through (508) are repeated until the TSP is empty, as indicated by step (510).

An embodiment of reservoir trajectory selection is illustrated in greater detail by FIGS. 6 and 7. A population of trajectory sets (TJSP) is generated as already described, where each member of the population is derived from the corresponding DHS in the previously created DHSP. As shown in step (600), geometrically valid trajectories (900) are computed using the existing well trajectory optimizer in Petrel. Note that the existing well trajectory optimizer honors both the DH locations and surface constraints such as limits on platform location and cost. One trajectory is created for each DH. To allow for a geometrically valid trajectory, the location of each node in the DH can shift within the bounds of the cell. As shown in step (602), the value of each trajectory is set to the previously computed value of the DH. A possible extension of the well trajectory optimizer would take each DHS to as an initial condition for the optimization, but would allow the DH connections between targets to be adjusted if this lowers the cost of the DHS. As shown in step (604), the cost of each trajectory is set to the cost of the trajectory computed by the optimizer. If the cost of a trajectory exceeds the value, as determined in step (606), then this trajectory may be eliminated. The trajectory cost also includes surface constraints. For example, platform costs can be determined by bathymetry, and distance from surface facilities can be determined from surface cost maps. In the final step (608), the size of the resulting TJSP is reduced to provide the highest net (value−cost) subset. The reduction could be in the order of a factor of 10.

Figure 8:
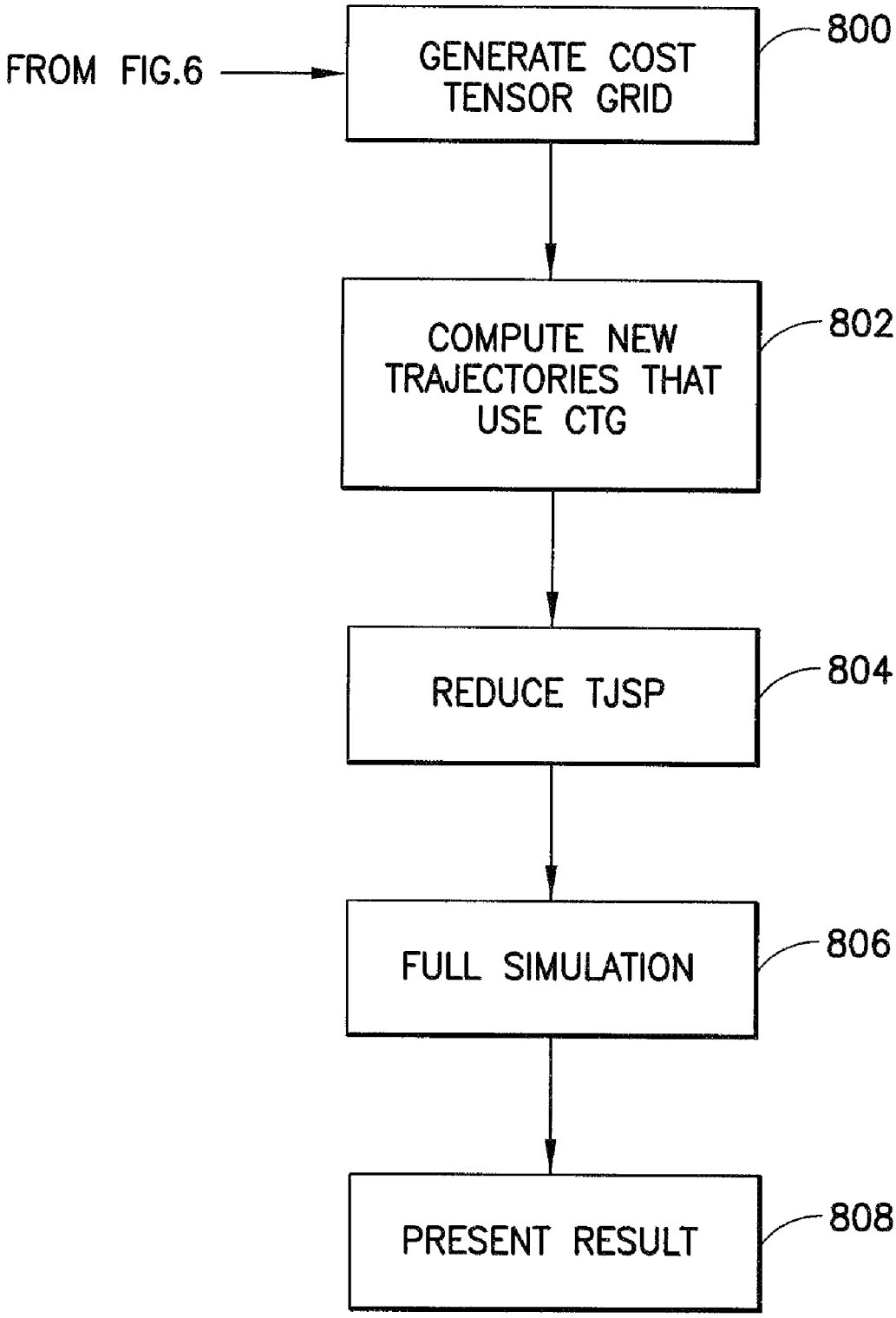
FIG. 8 illustrates an overburden trajectory selection algorithm and FDP selection algorithm.
Figure 9:
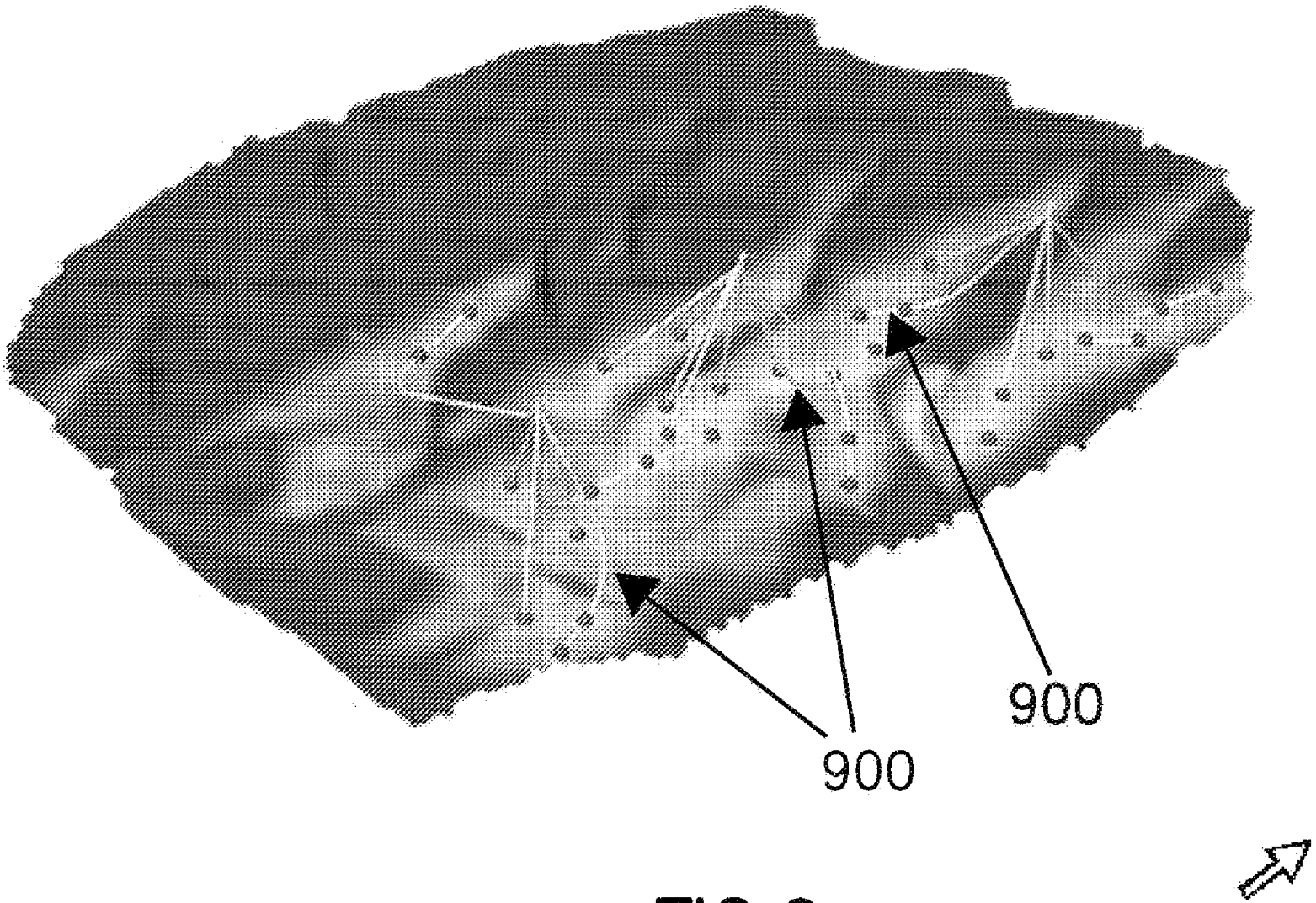
FIG. 9 illustrates selected overburden trajectories and production platform locations in the field of FIG. 2.

An embodiment of overburden trajectory selection is illustrated in greater detail by FIGS. 8 and 9. In this embodiment the TJSP created in the previous step (608, FIG. 6) is modified to optimize for overburden effects such as drilling hazards. As shown in step (800), a Cost Tensor Grid ("CTG") is generated for the overburden to define the costs of drilling and construction through the overburden. Each cell in the overburden now has a cost associated with drilling through that cell. The cost is a tensor because it may be relatively inexpensive to drill in one direction while relatively expensive to drill in another direction. For example, if a cell is associated with an east-west striking fault, it might be expensive to drill parallel to the fault (east-west), but relatively inexpensive to drill normal to the fault (north-south). The CTG can be computed with a geomechanical engine, e.g., OspreyRisk. For each trajectory set (TJS) in the TJSP, the existing well trajectory optimizer is executed to compute new trajectories that use the CTG as part of the objective function as indicated by step (802). The size of this new TJSP is reduced as indicated by step (804) to produce a highest net (value−cost) subset. The reduction could be in the order of a factor of 10.

FDP Selection is performed on the relatively small TJSP produced from the previous step. The operation includes rigorous reservoir simulations. As illustrated by step (806), for each TJS in TJSP, a full reservoir simulation is performed. The financial value of the reservoir production streams, possibly expressed as a net present value (NPV)NPV, may be utilized to rank members of the TJSP. As shown in step (808), results are then presented in tangible form, such as printed, on a monitor, and recorded on computer readable media. For example, the member with the greatest NPV and the ranking may be presented.

Figure 10:
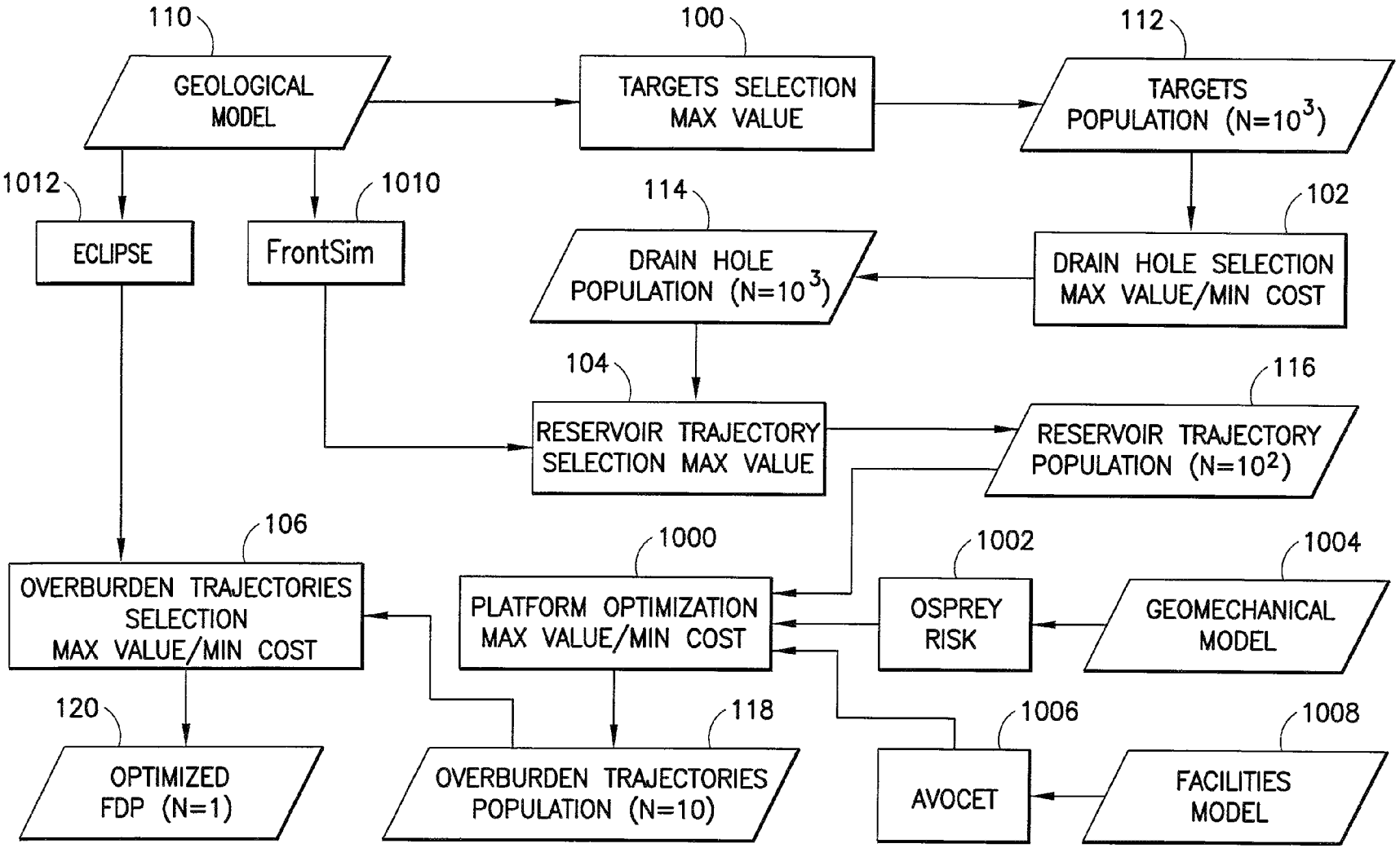
FIG. 10 illustrates an alternative embodiment in which geomechanical and facilities models are utilized to further refine the population of trajectory sets.

Referring now to FIG. 10, in an alternative embodiment additional models and analysis tools are utilized to further refine the TJSP in a platform optimization step (1000) before calculating NPV. In particular, a sophisticated single well risk and costing tool (e.g. Osprey Risk) (1002) may be utilized on a geomechanical model (1004) to refine the TJSP based on subsurface stresses. Further, an integrated asset management too (e.g. Avocet) (1006) may be used on a facilities model (1008) to refine the TJSP based on subsurface constraints such as locations of existing facilities like delivery pipelines. In this embodiment, a high speed reservoir simulator (e.g. FrontSim (1010)) and a high precision reservoir simulator (e.g. Eclipse) (1012) operate on the geological model. Other models and analysis tools may also be utilized.

The embodiments outlined above operate on a single "certain" geological, geomechanical and facilities model. Modem modeling tools such as Petrel 2007 allow "uncertain" earth models to be generated. The invention described here could be implemented within this context so that an "uncertain" FDP would be generated. An uncertain earth model is typically described through multiple realizations of certain earth models. As such, an embodiment of an uncertain FDP would be through multiple realizations.

It is important to recognize that because of unknown and incalculable factors, the most successful, robust and efficient realization may differ from the results of the computation. Further, it is important to note that different problems may demand different realizations of the algorithm.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. A method of calculating a development plan for at least a portion of a field containing a subterranean resource, comprising the steps of:

identifying a population including a plurality of targets for draining a reservoir in the field from a geological model;

reducing the population of targets by selecting a first subset of the targets with a first analysis tool, wherein said first analysis tool utilizes a first set of algorithms for selection of a first subset of targets and wherein the first subset of the targets comprises a population of reservoir trajectory sets;

reducing the first subset of targets by selecting a second subset of the targets with a second analysis tool, the second tool utilizing a second set of algorithms as compared to the first analysis tool and wherein the second subset of the targets comprises a population of overburden trajectory sets;

calculating a Field Development Plan (FDP) from the second subset of targets; and presenting the FDP in tangible form.

2. The method of claim 1 wherein each member of the population is a complete set of targets for draining a reservoir.

3. The method of claim 2 wherein each target is characterized by an associated stock tank oil initially in place ("STOIIP") value.

4. The method of claim 1 wherein reducing the first subset includes the further step of generating a population of drain hole sets.

5. The method of claim 4 wherein each member of a drain hole set includes reservoir-level control points in a borehole trajectory.

6. The method of claim 5 wherein each drain hole set is characterized by at least one value selected from the group including STOIIP, initial flow rate, decline curve profile, and material balance profile.

7. The method of claim 4 including the further step of generating a population of reservoir trajectory sets from the drain hole set population.

8. The method of claim 7 including the further step of calculating an economic value for at least some of the reservoir trajectory sets.

9. The method of claim 8 including the further step of selecting a subset of the reservoir trajectory sets based at least in-part on economic value.

10. The method of claim 1 including the further step of selecting a subset of the overburden trajectory sets based at least in-part on economic value.

11. The method of claim 10 including the further step of performing reservoir simulations on the selected subset of the overburden trajectory sets.

12. The method of claim 10 including the further step of utilizing a geomechanical model to remove from consideration members of the selected subset of the overburden trajectory sets.

13. The method of claim 10 including the further step of utilizing a facilities model to remove from consideration members of the selected subset of the overburden trajectory sets.

14. The method of claim 1 wherein calculating the FDP includes generating an uncertain FDP based on uncertain models.

15. The method of claim 14 wherein at least one uncertain earth model is described through multiple realizations of certain earth models, and including the further step of generating the uncertain FDP through multiple realizations.

16. A non-transitory computer-readable medium encoded with a computer program for calculating a development plan for at least a portion of a field containing a subterranean resource, comprising:

a routine which identifies a population including a plurality of targets for draining a reservoir in the field from a geological model;

a routine which reduces the population of targets by selecting a first subset of the targets with a first analysis tool wherein said first analysis tool utilizes a first set of algorithms for selection of a first subset of targets and wherein the first subset of the targets comprises a population of reservoir trajectory sets;

a routine which reduces the first subset by selecting a second subset of the targets with a second analysis tool, the second tool utilizing a second set of algorithms as compared to the first analysis tool and wherein the second subset of the targets comprises a population of overburden trajectory sets;

a routine which calculates a Field Development Plan (FDP) from the second subset of targets; and a routine which presents the FDP in tangible form.

17. The non-transitory computer-readable medium of claim 16 wherein each member of the population is a complete set of targets for draining a reservoir.

18. The non-transitory computer-readable medium of claim 17 wherein each target is characterized by an associated stock tank oil initially in place ("STOIIP") value.

19. The non-transitory computer-readable medium of claim 16 wherein the routine which reduces the first subset is operable to generate a population of drain hole sets.

20. The non-transitory computer-readable medium of claim 19 wherein each member of a drain hole set includes reservoir-level control points in a borehole trajectory.

21. The non-transitory computer-readable medium of claim 20 wherein each drain hole set is characterized by at least one value selected from the group including STOIIP, initial flow rate, decline curve profile, and material balance profile.

22. The non-transitory computer-readable medium of claim 19 further including a routine which generates a population of reservoir trajectory sets from the drain hole set population.

23. The non-transitory computer-readable medium of claim 22 wherein the routine which generates a population of reservoir trajectory sets is operable to calculate an economic value for at least some of the reservoir trajectory sets.

24. The non-transitory computer-readable medium of claim 23 wherein the routine which generates a population of reservoir trajectory sets is operable to select a subset of the reservoir trajectory sets based at least in-part on economic value.

25. The non-transitory computer-readable medium of claim 16 wherein the routine which generates a population of overburden trajectory sets is operable to select a subset of the overburden trajectory sets based at least in-part on economic value.

26. The non-transitory computer-readable medium of claim 25 further including reservoir simulations which are performed on the selected subset of the overburden trajectory sets.

27. The non-transitory computer-readable medium of claim 25 further including a routine which utilizes a geomechanical model to remove from consideration members of the selected subset of the overburden trajectory sets.

28. The non-transitory computer-readable medium of claim 25 including further including a routine which utilizes a facilities model to remove from consideration members of the selected subset of the overburden trajectory sets.

29. The non-transitory computer-readable medium of claim 16 wherein the routine that calculates the FDP generates an uncertain FDP based on uncertain models.

30. The non-transitory computer-readable medium of claim 29 wherein at least one uncertain earth model is described through multiple realizations of certain earth models, and wherein the routine that calculates the FDP generates the uncertain FDP through multiple realizations.

* * * * *